United States Patent [19]

Wagner

[11] Patent Number: 4,498,912

[45] Date of Patent: Feb. 12, 1985

[54] SUNSCREEN COVER APPARATUS FOR AN EVAPORATIVE COOLER

[76] Inventor: Theresia K. Wagner, 3110 N. 33rd St., Phoenix, Ariz. 85018

[21] Appl. No.: 444,318

[22] Filed: Nov. 24, 1982

[51] Int. Cl.[3] ..... B01F 3/04

[52] U.S. Cl. ..... 55/233; 261/29; 261/DIG. 43; 62/DIG. 16

[58] Field of Search ..... 261/29, DIG. 43; 55/233; 62/DIG. 13, DIG. 16; 312/100

[56] References Cited

U.S. PATENT DOCUMENTS

| | | | |
|---|---|---|---|
| 3,006,498 | 10/1961 | Thiede et al. | 312/100 |
| 3,148,514 | 9/1964 | Mathis | 62/DIG. 16 |
| 3,379,481 | 4/1968 | Fisher | 312/100 |
| 3,552,097 | 6/1971 | Grasseler | 261/29 |
| 3,834,683 | 9/1974 | McDuffee | 55/233 |
| 4,376,082 | 3/1983 | Heck | 261/29 |
| 4,379,712 | 4/1983 | Sperr, Jr. et al. | 62/29 |

*Primary Examiner*—Tim Miles

*Attorney, Agent, or Firm*—H. Gordon Shields

[57] ABSTRACT

Sunscreen cover for an evaporative cooler includes a top and screen panels extending downwardly from the top to cover the sides of an evaporative cooler for protecting the evaporative cooler by providing shade for the cooler.

5 Claims, 5 Drawing Figures

SUNSCREEN COVER APPARATUS FOR AN EVAPORATIVE COOLER

BACKGROUND OF THE INVENTION

1. Field of the Invention

This invention relates to an evaporative cooler, and, more particularly, to covers for an evaporative cooler to protect the evaporative cooler from direct sunlight.

2. Description of the Prior Art

Evaporative coolers are generally made of sheet metal. Sheet metal is used to form a rectangular housing. The sides of the evaporative cooler include cooler pad frames in which is disposed pad material that is soaked with water. Air is drawn through the water-soaked pads into the interior of the cooler housing. The air flowing through the water-soaked pad gives up heat in order to evaporate some of the water in the pads. The result is a lowered temperature of the air within the cooler and an increase in the humidity of that air. The cooled air then flows into the structure on which the evaporative cooler is located.

Generally speaking, there is a heat transfer between the outside of the cooler and the inside of the cooler due to the hot rays of the sun impinging directly onto the cooler housing. This heat serves to raise the temperature of the air within the cooler. This extra heat decreases the efficiency of the evaporative cooler by adding some of the heat back to the air that is lost or given off by the air as it flows through the water-soaked pads.

In order to reduce some of the heat increase due to the direct rays of the sun, there are several options available to the owner of the cooler. In some cases, a permanent shade structure is built above the cooler. This generally entails a separate structure which is secured directly to the roof of the structure and extends above the cooler. One problem with a permanent structure of that type is the unsightliness of it. Another problem is the added burden to the roof in terms of both weight and physical attachment.

Another way of decreasing the amount of heat gained through the cooler is to paint the roof of the cooler white or a light color which helps to reflect some of the direct sunlight. Since most of the coolers are made of metal, the light paint helps to reflect some sunlight, but there is still substantial heat gain through the top of the cooler housing.

The apparatus of the present invention overcomes the prio art problems by providing a lightweight, flexible sunscreen cover for an evaporative cooler.

SUMMARY OF THE INVENTION

The invention described and claimed herein comprises a flexible screen cover for an evaporative cooler which includes separable side panels for providing access to the cooler pad frames and which panels are secured to the roof to hold the cover apparatus in place on the evaporative cooler.

Among the objects of the present invention are the following:

To provide new and useful cover apparatus for an evaporative cooler;

To provide new and useful sunscreen apparatus for an evaporative cooler;

To provide new and useful flexible cover apparatus for an evaporative cooler; and To provide new and useful cover apparatus for an evaporative cooler having separable side panels to provide access to the evaporative cooler.

DESCRIPTION OF THE PREFERRED EMBODIMENT

Figure 1:
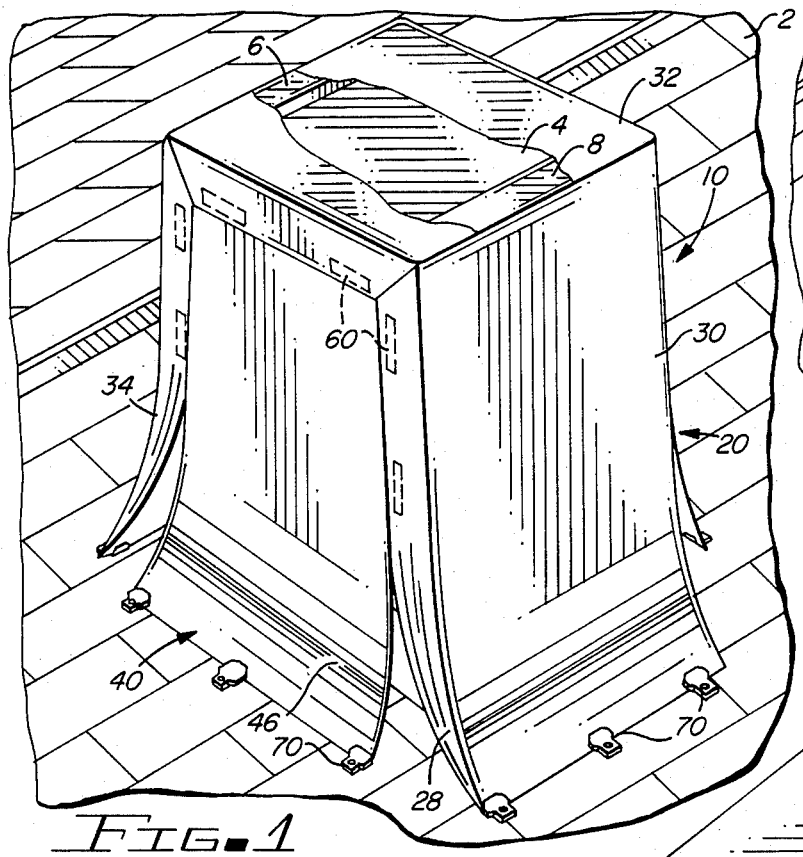
FIG. 1 is a perspective view of the apparatus of the present invention.

FIG. 1 is a perspective view of a roof 2, which is a pitched roof, with an evaporative cooler 4 disposed thereon. The cooler is appropriately secured to the roof. The evaporative cooler is of the traditional, well-known downdraft type.

The cooler 4 is shown in FIG. 1 covered or enclosed by an evaporative cooler cover apparatus 10 of the present invention. Extending laterally across the top of the evaporative cooler 4 are a pair of spacer elements 6 and 8. The spacer elements 6 and 8 are preferably made of relatively weatherproof and water resistant wood material, such as redwood or cedar. They may be typically short pieces of "2×4" construction material. If desired, the spacers may be made of plastic or other appropriate material. The purpose of the spacer element 6 and 8 is to provide a space between the top of the evaporative cooler 4 and a center portion 32 of the cooler cover apparatus 10. The spacers should also be lightweight elements, with minimal heat transfer capability.

Figure 2:
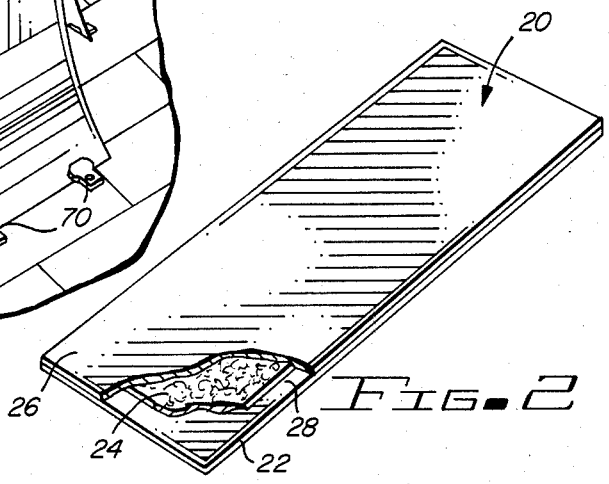
FIG. 2 is a perspective view of a portion of the apparatus of the present invention.
Figure 3:
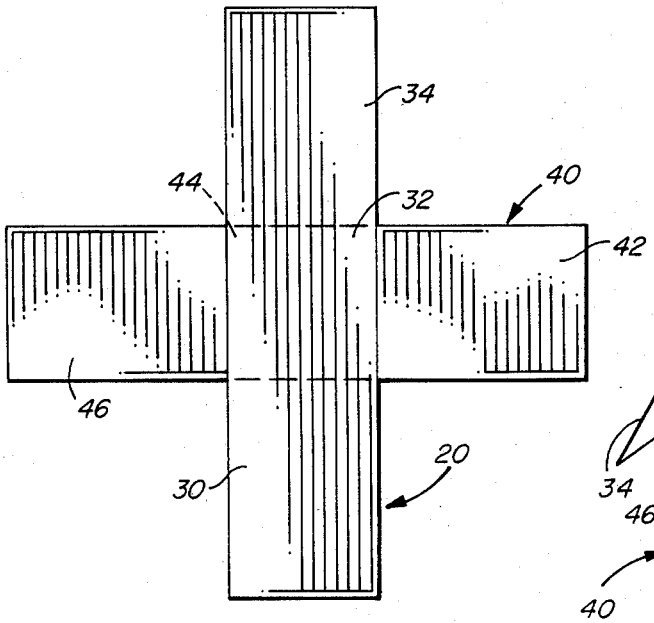
FIG. 3 is a top view of the apparatus of the present invention in its unassembled form.
Figure 4:
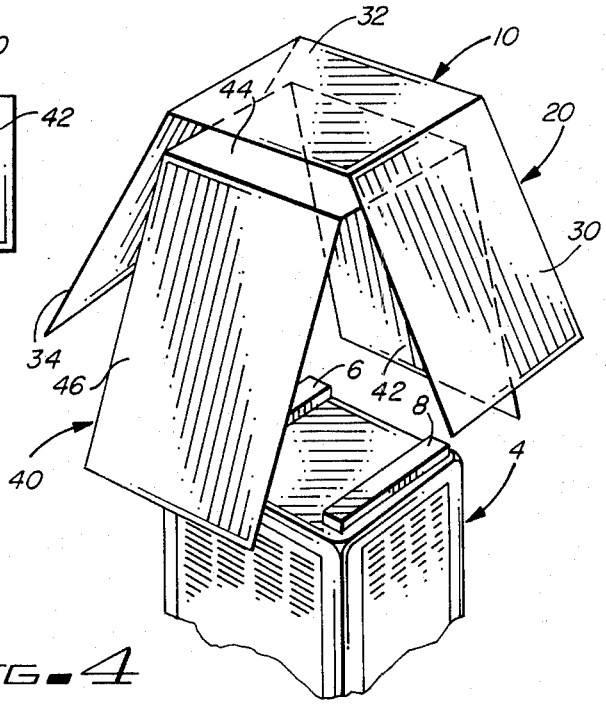
FIG. 4 is a perspective view of the apparatus of the present invention illustrating the assembly of the apparatus of the present apparatus in its use environment.

The cooler cover apparatus 10 is comprised of a pair of relatively elongated and generally rectangular screen panels, including a panel 20 and a panel 40. The two panels are disposed substantially perpendicularly to each other. The panel 20 is illustrated in FIG. 2, which comprises a perspective view of the panel 20 with a portion broken away to disclose the three elements of the panel. FIG. 3 is a top view of the panels 20 and 40. In FIG. 3, the panels 20 and 40 are shown in their open position, with the panel 20 being disposed on top of and substantially perpendicular to the panel 40. The panel 40 is the bottom or underneath panel, and the panel 20 is the top or outer panel with respect to the order of the panels as they are installed or placed on the cooler 4. In FIG. 4, the panels 20 and 40 are shown spaced apart from the cooler 4. In FIG. 4, the cooler cover apparatus 10 is illustrated in its use environment, preparatory to the final assembly of the cooler cover apparatus 10.

Sequentially, a single panel is fabricated, such as shown in FIG. 2. The two panels are then assembled to a cooler, similar to the manner illustrated in FIG. 4. After assembly, the cooler cover apparatus 10 appears as illustrated in FIG. 1. For the following discussion, reference will primarily be made to FIGS. 1, 2, 3, and 4.

The panel 20 is shown in FIG. 2 as having three layers. The three layers include a pair of outer layers 22 and 26 and an inner or spacer layer 24. The outer layers 22 and 26 are preferably air pervious screen material that will reflect the radiant energy of sunlight but that offers relatively little resistance to the flow of air. Accordingly, sunlight, and the heat therefrom, will be reflected from the screen material, but air will be able to flow through the material with very little resistance or blockage.

In FIG. 2, the outer layers 22 and 26 may be referred to as lower and upper screen layers, respectively. The terms "lower" and "upper" refer to the ultimate orientation of the panel 20 and its layers with respect to the cooler 4. Thus, the lower layer 22 will be disposed adjacent to the cooler, while the upper screen layer 26 will be disposed on the outside of the cooler, remote therefrom.

The spacer layer 24 is preferably filter material of some type, such as the aspen wood excelsior which is typically used as pad material for evaporative coolers. The spacer layer, along with the screen layers, helps to filter dirt particles or other particulate matter from the air stream and thus helps to keep the cooler pads in the cooler 4 clean.

It will be noted that the spacer layer 24 is not coextensive with the outer, or lower and upper, screen layers 22 and 26. Rather, there is a peripheral margin 28 about the spacer 24. The peripheral margin 28 preferably extends about the spacer layer 24, and thus between the outer edges of the spacer layer 24 and the outer edges of the panel 20.

The purpose of the margin 28 is for convenience in folding the outer edges of the panel 20, as best shown in FIG. 1. The width of the layer 24 is preferably about the same as the width of the cooler 4, while the overall width of the panel 20 is greater than the width of the cooler 4 to allow for the folding of the panel 20 around the corners of the cooler to secure the panel 20 to the panel 40 and to secure both panels to the cooler 4. The peripheral margin 28 provides a convenient manner for the folding of the panel 20, so that the cooler is substantially completely enclosed by the two panels 20 and 40.

The securing of the panel 20 to to the panel 40 is appropriately accomplished by fastening elements, such as "Velcro" strips 60. The "Velcro" strips 60 include two portions, one portion on the panel 20 and another, mating, portion on the panel 40.

The termination of the peripheral margin 28 before the outer ends as opposed to the sides, of the panel layers 22 and 26 allows for the fastening or securing of the panel 20 to the roof 2 with relative simplicity. Without the bulk of the spacer layer 24, the use of appropriate fastening elements, such as "Polyclips" 70, shown in FIG. 1 and in FIG. 5, enhances the securing of the panel 20, and also of the panel 40, to the roof 2. This will be discussed in more detail below.

The panel 40 is substantially identical in construction to the panel 20. However, it is not necessary that the panel 40 have as great a margin as the panel 20, since the panel 40 will not be folded. The width of the panel 40 is preferably the same as the width of the cooler 4. The folding of the panel 40 is not necessary, since only the outer panel 20 needs to be folded. This is shown in FIG. 1. Panel 20 is folded over, or on top of, the bottom panel 40.

The panel 40 includes upper and lower, or top and bottom, screen layers with an appropriate spacer layer disposed between them. The outer layer is, like the panel 20, preferably made of reflective screen material that will allow the flow of air through the material and yet will reflect sunlight. The spacer layer for the panel 40 is substantially identical to the spacer layer 24, ano thus is preferably excelsior material, typically made from aspen wood. Obviously, other appropriate material may be used for the spacer layers instead of the aspen wood, as discussed.

As shown in FIGS. 1, 3, and 4, the two panels 20 and 40 are disposed in the configuration of a cross, with the center of the cross comprising the top portion of the cooler 4. Both panels 20 and 40 accordingly include three general areas or portions, namely a top or center portion, and two side portions. For the panel 20, there are two side portions 30 and 34 and a center portion 32. The side portion 30 may be considered as the front portion and the side portion 34 may be considered as the back portion. The front portion 30 is slightly longer than the back portion 34. The reason for the front portion 30 being longer than the back portion 34 is due to the fact that the cooler apparatus 4 is pictured in FIG. 1 as being disposed on a pitched or hip roof. The "front" portion is accordingly slightly longer than the "back" portion 34. If the cooler apparatus 4 were disposed on a flat roof, the two side portions, or the front and back portions, would be generally of equal length.

Between the front portion 30 and the back portion 34 of the panel 20 is the top or center portion 32. The center portion 32 is disposed over a corresponding center portion 44 of the panel 40, and both center portions 32 and 44 are disposed on the top of the cooler 4, and on top of the spacer elements 6 and 8 thereon.

The panel 40 includes two side portions 42 and 46, which extend outwardly from the top portion 44. The side portions 42 and 46 may be of substantially equal length for both hip roof and flat roof cooler installations.

It will be noted that the width of the two panels 20 and 40 need not be, and probably will not be, the same. Rather, they are configured in accordance with the dimensions of the particular cooler to which they will be secured. While most evaporative coolers are generally square, they need not be so. The width of the layers 20 and 40 will be appropriately configured, regardless of the geometric proportions of the cooler to which the panels will be secured. And, as indicated above, the width of the outer panel 20 will be sufficient to allow for the folding of the side margins of the panel, as indicated in FIG. 1.

It will be noted that the folding of the marginal or peripheral edges of the panel 20, as shown in FIG. 1, is similar to what is commonly referred to as a hospital sheet tuck, typically used at the end of a bed sheet. The center portion is folded first, and the two sides are then folded over against the center portion and down along the sides of the lower panel 40. The securing of the peripheral portion 28 to the panel 40 is accomplished, as indicated, by appropriate fasteners, such as "Velcro" strips.

Figure 5:
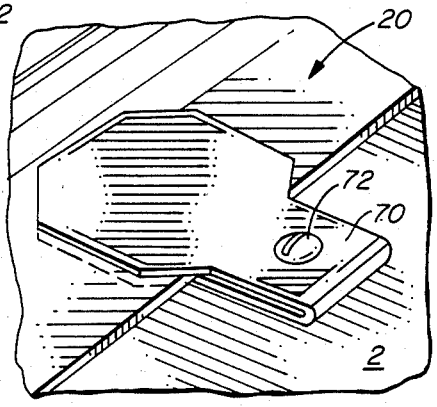
FIG. 5 is an enlarged perspective view of a portion of the apparatus of the present invention.

For securing the cover apparatus 10 to the roof 2, a plurality of appropriate fastening elements 70, such as "Polyclips" will be or may be used. A plurality of "Polyclips" 70 are shown in FIG. 1, and a "Polyclip" 70 is also shown in FIG. 5. FIG. 5 comprises an enlarged view of a "Polyclip" 70 secured to both the roof 2 and the edge of the front panel 20. A "Polyclip" is a folded element which is used to hold the edge of the screen panels between mating jaws of the element. A single screw 72 is used to secure the "Polyclip" 70 to the roof 2. An edge of the panel 20 extends between the jaws of the "Polyclip" 70 and is held therebetween. To release the panel 20, the jaws of the "Polyclip" 70, being flexible, are simply spread apart to release the panels. When the panels are again secured, they are fastened to the "Polyclip" by simply having the edges of the panels inserted between the jaws and the jaws are then closed.

As shown in FIG. 1, the bottom edges of the panels 20 and 40 are spaced outwardly from the bottom of the cooler 4, almost in a tent-like fashion. This provides more space between the cooler 4 and the cover 10 for air to circulate or to move in, thus providing a shading effect for the cooler 4 and for the air flowing into it.

For providing access to the interior of the cooler apparatus 4, or for allowing or providing selective access to any of the pad frames at the sides of the cooler apparatus 4, any one of the four side portions 30, 34, 42, or 46, may be lifted or removed from its assembled position, as shown in FIG. 1, by releasing its Polyclips and the "Velcro" fasteners associated therewith. If convenient, the lifted panel may simply be folded over the top of the cooler and draped over an adjacent, or opposite, panel portion.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Cover apparatus for an evaporative cooler having a top and sides, comprising, in combination:

flexible, air pervious panel means draped over the top and the sides of the evaporative cooler, including a refective top panel portion covering the top of the evaporative cooler, and reflective side panel portions covering the sides of the evaporative cooler, said top and side panel portions reflecting radiant energy and allowing air to flow through the panel means to the evaporative cooler; and fastening means for securing the panel means to the cooler.

2. The apparatus of claim 1 in which the panel means further includes a first screen layer having a reflective surface for reflecting the sunlight but allowing for the flow of air through the panel means.

3. The apparatus of claim 2 in which the panel means further includes a second screen layer and a spacer layer disposed between the first and second screen layers, both of which second screen layer and spacer layer allow for the flow of air through them and to the evaporative cooler, and all three layers of which define a filter for filtering particulate matter out of the air flowing to the evaporative cooler.

4. The apparatus of claim 1 in which the panel means further includes a first panel disposed over the evaporative cooler in a first direction and a second panel disposed over the evaporative cooler in a second direction substantially perpendicular to the direction of the first panel for allowing selective access to the sides of the evaporative cooler.

5. The apparatus of claim 4 in which the first panel and the second panel are secured together to enclose the evaporative cooler.

* * * * *